US006869035B2

(12) United States Patent
Doud

(10) Patent No.: US 6,869,035 B2
(45) Date of Patent: Mar. 22, 2005

(54) EXTENSION SPRAY DEVICE

(76) Inventor: Alton J. Doud, 1319 Jeffwood Dr., Waterford, MI (US) 48327

( * ) Notice: Subject to any disclaimer, the term of this patent is extended or adjusted under 35 U.S.C. 154(b) by 0 days.

(21) Appl. No.: 10/386,588

(22) Filed: Mar. 12, 2003

(65) Prior Publication Data

US 2004/0195371 A1 Oct. 7, 2004

(51) Int. Cl.[7] ..... B05B 15/08

(52) U.S. Cl. ..... 239/588; 239/587.1; 239/280; 222/527; 222/523; 222/174

(58) Field of Search ..... 239/588, 337, 239/587.1, 281, 280, 280.5; 222/527, 543, 523, 402.1, 402.13–402.15, 530

(56) References Cited

U.S. PATENT DOCUMENTS

| | | | | |
|---|---|---|---|---|
| 1,006,078 A | | 10/1911 | Fulford | 222/523 |
| 1,595,231 A | | 8/1926 | Dryer | 222/523 |
| 1,631,951 A | | 6/1927 | McAnsh | 222/523 |
| 2,049,900 A | | 8/1936 | Evans et al. | 222/488 |
| 2,968,441 A | | 1/1961 | Holcomb | 239/337 |
| 3,101,904 A | | 8/1963 | Prussin et al. | 239/337 |
| 3,110,426 A | * | 11/1963 | Bishop | 222/505 |
| 3,173,579 A | | 3/1965 | Curie et al. | 222/105 |
| 3,419,197 A | | 12/1968 | Battaglia | 222/485 |
| 3,913,842 A | | 10/1975 | Singer | 239/337 |
| 4,664,300 A | | 5/1987 | Strickland | 222/402.13 |
| 5,540,359 A | | 7/1996 | Gobbel | 222/174 |
| 6,253,971 B1 | | 7/2001 | Cobb | 222/402.1 |

FOREIGN PATENT DOCUMENTS

| | | | |
|---|---|---|---|
| GB | 1144385 | 3/1969 | 222/527 |

* cited by examiner

*Primary Examiner*—Patrick Brinson
(74) *Attorney, Agent, or Firm*—The Weintraub Group, PLC

(57) ABSTRACT

A spray extension device for a spray can includes at least a pair of telescopable extension tubes fitted to and in fluid communication with the valve stem of a spray can. Advantageously, the extension tubes are fitted to a closure cap which, in turn, is fitted to the valve stem, and, thereby, in fluid communication with the interior of the can. Depressing of the closure cap causes the valve stem to issue fluid therethrough, into the tubes.

10 Claims, 2 Drawing Sheets

EXTENSION SPRAY DEVICE

BACKGROUND OF THE INVENTION

1. Field of the Invention

This invention relates broadly to extension spray devices. More particularly, it concerns such devices that are coupled to the closure cap of a conventional aerosol spray can having a moveable control valve stem in fluid communication with the closure cap.

2. Description of the Prior Art

Aerosol dispenser cans, popularly called "spray cans," are widely used for containing and, then, spraying many different types of compositions held under pressure onto various surfaces. Frequently, it is desirable to apply the sprayed material on a surface that is not conveniently reached with the spray can held in the hand of the user, such as when spraying paint on a ceiling or spraying insecticide along a baseboard. Such situations make it desirable to have a device in the nature of an extension, which may be attached to the spray can and operated by the user to spray areas located remotely from the spray nozzle. Typically, these aerosol containers and spray containers that are pressurized by hand actuated pumping heads include a depressible plunger mechanism which, when depressed, actuates a spray dispensing valve mechanism to expel fluid from the spray can.

The aerosol and like plunger actuated spray containers could be further advanced by additional improvements in spray extension devices that would provide advantages in operation, ease of can attachment, and detachment, in handling or the like, and direction of the spray to an area difficult to reach.

A principal object of the present invention is the provision of an improvement in extension spray devices capable of operating conventional spray containers or cans by pumping action.

Another object of this invention is the provision of an extension arm that is connectible in fluid relation to the control valve stem extending from an aerosol spray can for actuating the control valve and delivering contents of the spray can to a location remote thereto.

Another object is the provision of such devices to which a spray extension device can be attached or removed with little effort and in a minimum of time to a spray can or container but from which the spray extension device will not accidentally detach during use.

A further object is the provision of a spray can or container, which utilizes an uncomplicated, but highly effective spray extension device for operating the control valve thereof and delivering spray at a location remote to the discharge nozzle of the can.

A more particular object according to this invention is the provision of telescoping spray nozzle extender adapted for use in aerosol cans.

SUMMARY OF THE INVENTION

These objects are accomplished according to the present invention by an extension spray device for a conventional aerosol can having a moveable tubular control valve stem extending centrally out from the closure, the extension spray device which comprises:

a closure cap having an inlet socket dimensioned for gripping fitment to the valve stem, an outlet socket, and a conduit for communicating fluid content of the spray can from the inlet socket to the outlet socket, and a spray extension assembly, the extension assembly including:

a first spray tube, the first spray tube being axially elongated and having rearward and forward end portions, the rearward end portion being dimensioned for removable gripping fitment with the outlet socket and the forward end portion being provided with a radially inwardly extending shoulder, and a second spray tube, the second spray tube being axially elongated and having rearward and forward end portions, the rearward end portion being provided with a radially outwardly extending first abutment, and wherein said second spray tube is dimensioned for coaxial slidable fitment within said first spray tube, said first abutment being dimensioned to engage said shoulder and prevent removal of the second spray tube from the first spray tube.

Preferably, the spray extension assembly includes an axially elongated third spray tube having rearward and forward end portions and dimensioned for coaxial slidable movement within the second spray tube, the rearward and forward end portions of the third and second tubes being provided, respectively, with an abutment that extends radially outwardly and radially inwardly with the inwardly extending abutment of the second tube being adapted to engage the outwardly extending abutment of the third tube to prevent removal of the third spray tube from the second spray tube.

If desired, an axially elongated fourth spray tube may be provided for coaxial slidable movement within the third spray tube and the rearward and forward ends of each, respectively, being provided with an outwardly and inwardly extending abutment to prevent removal of the fourth spray tube from the third spray tube.

In some applications, instead of removable gripping fitment with the outlet socket, the spray extension assembly is fixedly secured to the closure cap. Such fixation may be by adhesive or thermal bonding of the outer tube to the closure cap. Further, in some applications, a second flow closure cap is grippingly removably attached to the forward end of the innermost of the spray extension tube members to enable the user to direct the flow at a predetermined angle relative to the axis of the valve stem, such as at 90° thereto.

In a preferred method of assembly, a spray extension assembly is formed by providing a plurality of tubular members of predetermined diameter, cutting the tubular members to a desired axial length whereby to provide an inner, a center and an outer tube member, each tube member having a forward and a rearward end portion with the cross-sections thereof being dimensioned such that the intermediate or center tube member will telescope for slidable fitment about the inner tube member and the outer tube member will telescope for slidable fitment about the center tube member, forming a radially outward abutment on the rearward end portion of the inner and center tube members, forming a radially inward abutment on the forward end portion of the center and outer tube members, inserting the forward end portion of the inner tube into the rearward end portion of the center tube, and inserting the forward end portion of the tube subassembly thus formed into the rearward end portion of the outer tube.

Thereafter, a closure cap having a flow-receiving socket in fluid communication with an outlet socket is provided and the rearward end portion of the outer tube member is connected to the outlet socket. The connection can be by frictional engagement to enable removable detachment, or by fixed securement.

Preferably, each abutment thus formed defines a radial flange, with the outward flange at the rearward end of the inner and center tube members being dimensioned to seat in a clearance fitment about the inner wall of the tube member into which inserted, and the inward flange at the forward end of the outer tube and center tube members being dimensioned to seat in a clearance fitment about the outer wall of the center and inner tube members. The respective flanges are adapted to enhance centered coaxial sliding relative movement between the tube members. Further, the respective flanges are adapted to be brought into engagement with one another to prevent outward removal of the inner tube member from the inner tube member, and the center tube member from the outer tube member.

Preferably, the forming step includes heat deforming or swaging the end portions of the respective tube members, such as by coaxially inserting a conical-shaped heat element into the tubular member to form the outward radial flange, or coaxially disposing a conical-shaped recess about the end of the tubular member to form the inward radial flange.

Desirably, the spray extension member and associated closure caps are provided in kit form.

Further, the spray extension device according to the invention herein is desirably adapted to be connected to the spray socket of a conventional hand actuated spray container, wherein hand actuation of the spray head thereof pressurizes and forces the fluid contents thereof outwardly of the container.

Other objects and further scope of applicability of the present invention will become apparent from the detailed description given hereinafter; it should be understood, however, that the detailed description, while indicating preferred embodiments of the invention, is given by way if illustration only, since various changes and modifications within the spirit and scope of the invention will become apparent to those skilled in the art from this detailed description.

BRIEF DESCRIPTION OF THE DRAWINGS

A more complete understanding of the new extension spray devices of the invention can be had by reference to the attached drawings in which.

DESCRIPTION OF THE PREFERRED EMBODIMENTS

Figure 1:
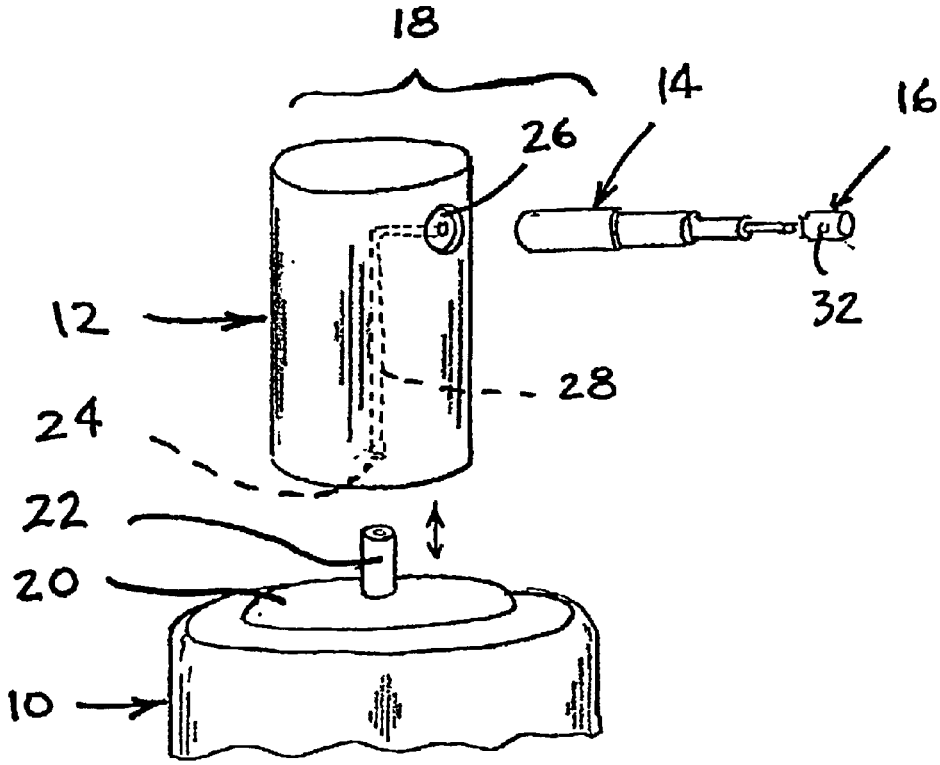
FIG. 1 is a perspective view of an extension spray device positioned for detachable connection to an aerosol spray can in accordance with the invention.

Referring in detail to the drawings, in a preferred embodiment according to this invention, a spray can or container 10, a closure cap 12, an extension spray assembly 14, and a closure cap 16 are shown positioned for assembly. Although the spray assembly 14 is configured for detachable connection to the spray can 10, as will be described herein below, the spray assembly 14 preferably is fixedly attached to the closure cap 12 and forms a one-piece extension spray device 18 therewith.

The spray can 10 shown is a conventional aerosol type container which contains fluid contents under pressure The spray can has a profiled body portion or domed head 20, a control valve (not shown), and a tubular valve stem 22 that extends centrally out from the domed head and into operable connection with the control valve. In operation, the valve stem 22 is forced downwardly towards the domed portion, whereupon the control valve is actuated and fluid is communicated outwardly of the can.

As will be appreciated, although the extension spray assembly 14 is shown positioned for operable connection to the closure cap 12, the spray assembly may also be connected to the outlet or discharge port of a conventional hand actuated spray container (not shown). These hand-actuated spray containers are well known and include a spray head, an elongated tube member which is immersed in and draws fluid content from the container, and a trigger member which when moved creates a pressure differential that results in the fluid being forced upwardly of the tube member and outwardly of an orifice provided in the spray head. These containers are exemplified by Windex®, 409®, Tilex® and like spray cleaner bottles and will not be described further herein.

The closure cap 12 comprises a generally cylindrical body and has a recessed inlet or socket 24 sized to grippingly removably engage the outer periphery of the valve stem 22, a recessed outlet or socket 26 sized to grippingly removably engage the outer periphery of the rearward end portion of the extension spray assembly 14, and an L-shaped bore 28. The bore 28 extends between the inlet and outlet 24 and 26 of the closure cap for communicating and directing the flow of fluid through the cap.

Similarly, the closure cap 16 comprises a generally cylindrical body having a recessed inlet or socket 30 to grippingly removably engage the outer periphery of the forward end portion of the extension spray assembly, an outlet 32, and an interior bore extending between the inlet an outlet 30 and 32 for receiving and directing fluid from the spray assembly 14.

Figure 3A:
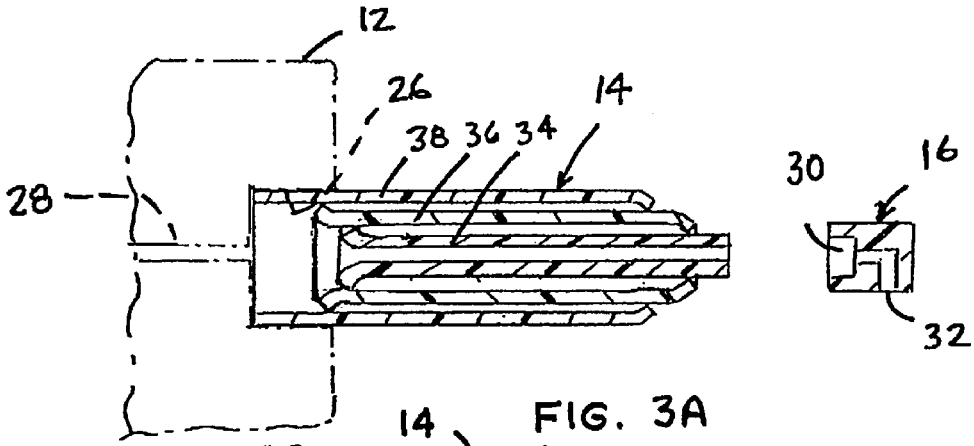
FIGS. 3A, 3B, and 3C are fragmentary views, partially in section, respectively, showing the extension spray device of FIG. 1 with the spray control valve retracted, partially extended, and fully extended.
Figure 3B:
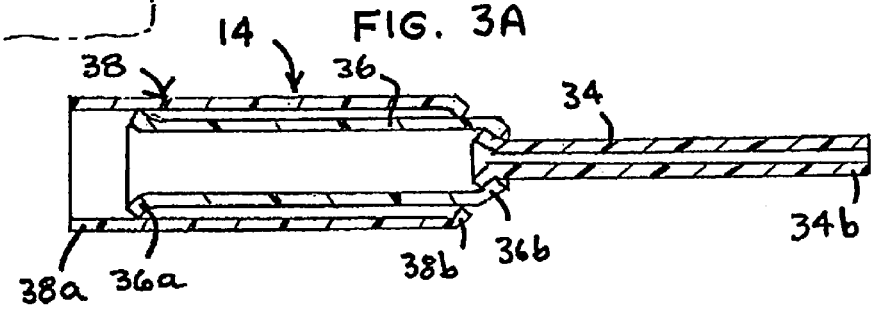
Figure 3C:
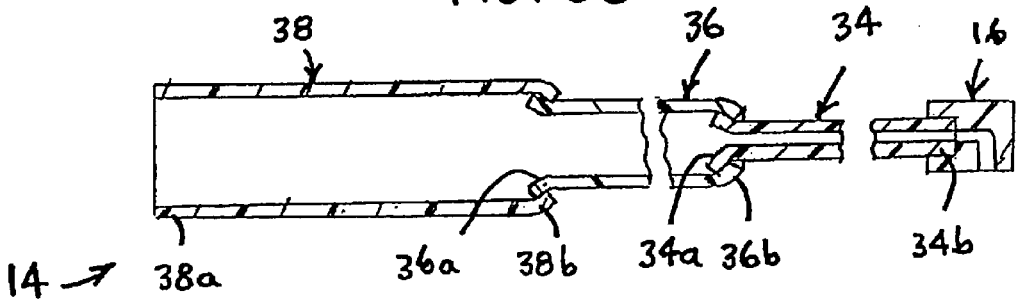

As shown best in FIGS. 3A, 3B and 3C, the extension spray assembly 14 includes a plurality of axially elongated cylindrical tubes 34, 36 and 38 that are assembled together in coaxial telescoping relation to one another. The tubes 34 and 36, and 36 and 38 are dimensioned so as to be axially slidably movable relative to one another from a fully retracted position (FIG. 3A), to a partially extended position (FIG. 3B), and into a fully extended position (FIG. 3C).

Each tube 34, 36, and 38 has a rearward end portion 34*a*, 36*a*, and 38*a* and a forward end portion 34*b*, 36*b*, and 38*b*, with the tube 34 being dimensioned to fit within the tube 36, and the tube 36 being dimensioned to fit within the tube 38. The outermost tube 38 is dimensioned such that the rearward end portion 38*a* thereof forms an interference fit within the socket 26 of the closure cap 12 and forms a removable gripping fitment therewith and the forward end portion 38*b* thereof forms a radially inwardly extending abutment or shoulder.

The center tube 36 is dimensioned for slidable fitment within the outer tube 38 and the forward end and rearward end portions 36*b* and 36*a* thereof form radially inwardly and outwardly extending abutments or shoulders.

Similarly, the inner tube 34 is dimensioned for slidable fitment within the central tube 36 and the rearward end portion 34*a* thereof forms a radially outwardly extending shoulder or abutment. The forward end portion 34*b* of the tube 34 is dimensioned to form an interference fit within the socket 30 of the closure cap 16.

The closure cap 16 is grippingly removably attached to the forward end 34*b* of the innermost tube 34 of the spray extension assembly 14 to enable the user to direct the flow at a predetermined angle relative to the axis of the valve stem 22, such as at 90° thereto.

The inwardly extending and outwardly extending shoulders or abutments 38*b* and 36*a* of the outer and center tubes 38 and 36, and inwardly and outwardly extending shoulders or abutments 36*b* and 34*a* of the center and inner tubes 36 and 34, respectively, are dimensioned such that the outwardly extending shoulders can slidingly engage the inner wall of the tube in which interfitted, and the inwardly extending shoulders can slidingly engage the outer wall of the tube about which circumposed.

Importantly, the shoulders or abutments form two important functions. First, the shoulders ensure centered coaxial slidable fitment between two interfitted tubes. Second, the shoulders prevent unwanted removal between the interfitted tubes. For example, when the tube 34 moves from the retracted position to the extended position, the rearward shoulder 34*a* is brought into engagement with the forward shoulder 36*b* and retained within the spray assembly.

The spray extension assembly 14 may include only an outer and an inner tube.

Further, the spray extension assembly 14 may include a fourth axially elongated tube dimensioned for coaxial slidable fitment within the innermost tube of the tube assembly. Referring to the assembly 14 herein, the forward end portion of the tube 34 would form a radially inwardly extending shoulder to engage to outer wall of the fourth tube, and the rearward end portion of the fourth tube would form a radially outwardly ending shoulder or abutment to slidingly engage the inner wall of the tube 34. Movement of the fourth tube relative to the assembly would move the rearward end portion of the forth tube into engagement with the forward end portion of the shoulder thus provided on the forward end portion of the tube 34.

In some applications, instead of removable gripping fitment with the outlet socket, the spray extension assembly 14 is fixedly secured to the closure cap 12. Such fixation may be by adhesive or thermal bonding or sonic welding of the outer tube to the closure cap.

In a preferred method of assembly, the spray extension assembly 14 is formed by providing a plurality of tubular members, each tube member being axially elongated, generally cylindrical, and having a predetermined diameter. The tubular members are then cut to a desired axial length whereby to provide the inner tube member 34, the center tube member 36, and the outer tube member 38.

A radially outward extending abutment is provided on the rearward end portion of the inner and center tube members 34 and 36, and a radially inward extending abutment is provided on the forward end portion of the center 36 and outer tube members 38. The cross-sections of the tube members and associated shoulders are dimensioned such that the inner tube member 34 will telescope for coaxial sliding fitment within the intermediate or center tube member 36, and the center tube 36 will telescope for coaxial sliding fitment within the outer tube member 38.

The forward end portion 34*b* of the inner tube 34 is inserted into the rearward end portion 36*a* of the center tube 36, and the forward end portion of the tube subassembly thus formed is inserted into the rearward end portion 38*a* of the outer tube 38, thereby providing the spray extension assembly 14.

Thereafter, the rearward end portion 38*a* of the spray assembly 14 is fitted to the outlet socket 26 of the closure cap 12. The connection can be by frictional engagement to enable removable detachment, or by fixed securement.

Preferably, each abutment or shoulder thus formed defines a radial flange, each radial flange extending 360°.

Figure 2A:
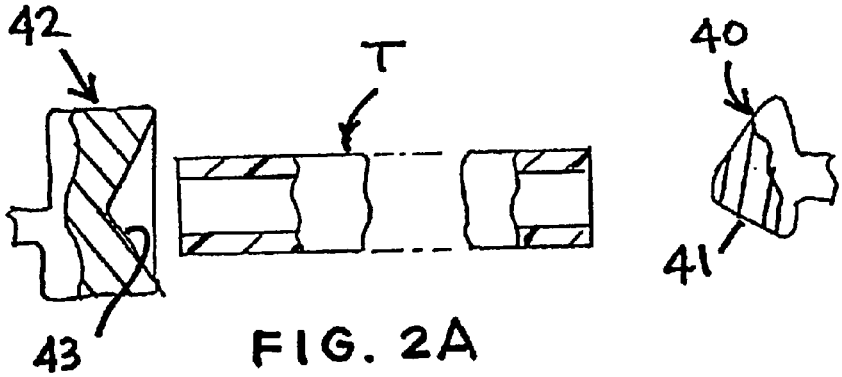
FIGS. 2A and 2B are fragmentary views, partially in section, showing preparation of a spray element in accordance with this invention.
Figure 2B:
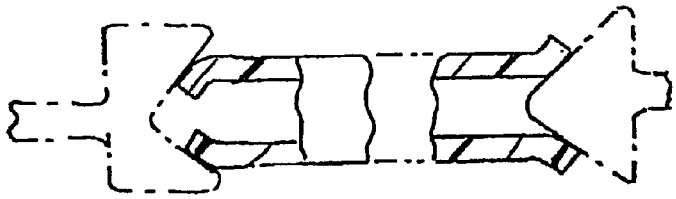

Preferably, as shown in FIGS. 2A and 2B, the forming step includes heat deforming or swaging the opposite end portions of a respective tube member "T", such as by coaxially inserting a heat element 40 having a conical-shaped end portion 41 into the tubular member "T" to form an outward radial flange, or coaxially disposing a heat element 42 having a conical-shaped recess 43 about the end of the tubular member to form the inward radial flange.

However, the flanges may be pre-formed and extend, respectively, around and inwardly of the tube.

Preferably, the spray assembly 14 and closure caps 12 and 16 are comprised of a suitable plastic material, e.g., high-density polyethylene, polypropylene or comparable thermoplastic material. However, these items may be separately formed of plastic, metal or the like and assembled, e.g., by spot welding.

Desirably, the spray extension assembly 14 and associated closure caps 12 and 16 provide a kit for assembly to an associated spray can.

In operation, the spray extension assembly 14 is assembled to the closure cap 12 by frictional engagement within the socket 26 thereof, and the cap 12 fitted about the upward end portion of the valve stem of the aerosol spray can. If desired, the closure cap 16 is frictionally fitted about the forward end of the tube 38. The closure cap 12 is forced downwardly (towards the can), causing the valve stem 22 to be moved downwardly and into operative engagement with the control valve, whereby the contents of the can are communicated into the valve stem, through the L-shaped bore 28, through the spray extension assembly 12 and discharged from the inner tube 34 thereof.

While the invention is shown and described with particularity to pressurized aerosol type cans, the benefits of the invention are applicable to spray containers of the type having a discharge head that discharges fluid from the container via a discharge opening provided in the discharge head. In either type of container, the spray extension device 12 enables fluid to be communicated to remote areas.

The new extension spray devices as described although simple in construction and inexpensive to manufacture are easy to use. They permit aerosol spray cans to be efficiently used to apply sprayed material to surfaces that would be difficult, or even impossible, to reach by holding the spray can in the hand of the user. The new extension devices can also serve to protect the user against inhaling sprayed materials or involving the user with other hazards, e.g., bees or wasps, during the use of aerosol spray cans for certain applications.

Having, thus, described the invention, what is claimed is:

1. An extension spray device for an internally pressurized aerosol spray can having a moveable tubular control valve stem extending upwardly from the top of the can and generally aligned with the central axis of the can, comprising:

a first closure cap, said closure cap having an inlet socket dimensioned for gripping removable fitment to the valve stem, an outlet socket, and a conduit for communicating fluid content of the spray can from the inlet socket to the outlet socket, wherein movement of said closure cap in a direction towards said spray can causes said valve stem to move and permit fluid to be discharge from said aerosol spray can, and a spray extension assembly, the assembly being removably mountable to the outlet socket of said closure cap and including:

a first spray tube, the first spray tube being axially elongated and having rearward and forward end portions, the rearward end portion being dimensioned for gripping removable fitment with the outlet socket of said closure cap and the forward end portion being provided with a radially inwardly extending shoulder, and a second spray tube, the second spray tube being axially elongated and having rearward and forward end portions, the rearward end portion being provided with a radially outwardly extending first abutment, and wherein said second spray tube is dimensioned for coaxial slidable fitment within said first spray tube, said first abutment being dimensioned to engage said shoulder and prevent removal of the second spray tube from the first spray tube.

2. The extension spray device of claim 1 which further comprises:

a second closure cap, said second closure cap having an inlet socket dimensioned for gripping removable fitment with the forward end portion of said second spray tube, discharge outlet, and a fluid conduit for communicating fluid received from the second spray tube to the discharge outlet.

3. The extension spray device of claim 1 wherein the fluid conduit in said first closure cap includes first and second portions which are substantially at right angles to one another wherein to change the direction of the fluid discharged from said spray extension assembly.

4. The extension spray device of claim 3 wherein the second portion of said fluid conduit in said first closure cap is coaxial with the first and second spray tubes.

5. The extension spray device of claim 1 wherein the spray extension assembly includes an axially elongated third spray tube having rearward and forward end portions and dimensioned for coaxial slidable movement within the second spray tube, the rearward and forward end portions of the third and second tubes being provided, respectively, with an abutment that extends radially outwardly and radially inwardly with the inwardly extending abutment of the second tube being adapted to engage the outwardly extending abutment of the third tube to prevent removal of the third spray tube from the spray tube, and the extension spray device further comprises a second closure cap, the second closure cap having an inlet socket dimensioned for gripping removable fitment about the forward end of said third spray tube.

6. The extension spray device of claim 5 wherein the second closure cap further includes a discharge outlet, and a fluid conduit for communicating fluid received between the inlet and outlets thereof wherein to discharge fluid received from the third tube outwardly of the spray assembly.

7. A kit for use with an aerosol spray can having a movable control valve actuator stem projecting upwardly from an end cap formed at one end of the spray can and movable in a direction towards the end cap, the kit comprising:

a closure cap to mount to the valve actuator stem and move with the stem towards the end cap, the closure cap comprising a substantially solid generally cylindrical body having an inlet socket dimensioned for gripping removable fitment to the valve stem, an outlet socket, and a conduit for communicating fluid content of the spray can from the inlet socket to the outlet socket, and a spray extension assembly to mount to the outlet socket of the of the closure cap, the spray extension assembly including inner and outer generally cylindrical spray tubes each having a rearward and forward end portion, the rearward end portion of said outer spray tube, being dimensioned for gripping removable fitment with the outlet socket of said closure cap, and engagement structure operating the forward and rearward end portions of said outer and inner spray tubes, and wherein said tubes are disposed in coaxial relation and movable relative to one another, and said engagement structure operates to prevent removal of the inner spray tube from the outer spray tube.

8. The kit as claimed in claim 7, further comprising a second closure cap, said second closure cap including an inlet socket for grippingly removably engaging the outer periphery of the forward end portion of said inner spray tube.

9. The kit as claimed in claim 8, wherein said second closure cap comprises a generally solid body and includes an outlet socket and a fluid conduit extending between the inlet and outlet sockets thereof for communicating fluid therethrough, the inlet socket of said second closure cap being in fluid communication with the valve stem when the first closure cap is fitted to the valve stem and the second closure cap is fitted to the spray tube.

10. The kit as claimed in claim 7, wherein said spray assembly includes at least one spray tube disposed in movable sliding coaxial relation between said inner and outer spray tubes, and second engagement structure operating between the at least one spray tube and said inner and outer tubes for preventing unwanted removal of said at least one spray tube from said spray assembly.

* * * * *